US005975345A

United States Patent [19]

Taylor

[11] Patent Number: 5,975,345

[45] Date of Patent: Nov. 2, 1999

[54] LID ASSEMBLY INCLUDING PIVOTALLY-ATTACHED LID PROP MEMBER

[76] Inventor: Craig V. Taylor, 22502 S. Summit Ridge Cir., Chatsworth, Calif. 91311

[21] Appl. No.: 09/093,428

[22] Filed: Jun. 8, 1998

Related U.S. Application Data

[63] Continuation-in-part of application No. 08/858,349, May 19, 1997, Pat. No. 5,868,267.

[51] Int. Cl.[6] ..... B65D 51/04

[52] U.S. Cl. ..... 220/826; 220/831; 220/832; 220/844; 220/848; 220/908; D34/11

[58] Field of Search ..... 220/826, 831, 220/832, 844, 848, 908; D34/11

[56] References Cited

U.S. PATENT DOCUMENTS

| | | | |
|---|---|---|---|
| 1,092,039 | 3/1914 | Goldstein | 220/826 |
| 2,663,392 | 12/1953 | Miller | 220/826 X |
| 3,140,344 | 7/1964 | Slater et al. . | |
| 3,858,744 | 1/1975 | Garvert | 220/826 X |
| 3,866,936 | 2/1975 | Hedges . | |
| 3,979,007 | 9/1976 | Thornbloom, Jr. . | |
| 4,114,236 | 9/1978 | Vandervort . | |
| 4,558,799 | 12/1985 | Hammond . | |
| 4,972,966 | 11/1990 | Craft, Jr. . | |
| 5,546,705 | 8/1996 | Hirtsiefer | 220/832 X |
| 5,673,811 | 10/1997 | Dickinson et al. . | |

*Primary Examiner*—Stephen K. Cronin
*Attorney, Agent, or Firm*—Oppenheimer Wolff & Donnelly LLP

[57] ABSTRACT

A lid assembly for a refuse container includes a lid member pivotally attached to the upper surface of the refuse container, a lid prop and a mechanism for pivotally attaching the lid prop to the container. The lid member includes a cam-shaped lobe which contacts the upper surface of the container when the lid member is in an open position limiting the range of pivoting motion of the lid member. The lid member further includes a bottom surface and a front surface. When pivoted to a lid supporting position, a lid supporting surface of the lid prop contacts the bottom surface of the lid member and a flange of the lid prop faces the front surface of the lid member. The lid prop is pivotally coupled to the refuse container such that gravity forces the flange toward the front surface of the lid member when the container is in its upright position.

18 Claims, 10 Drawing Sheets

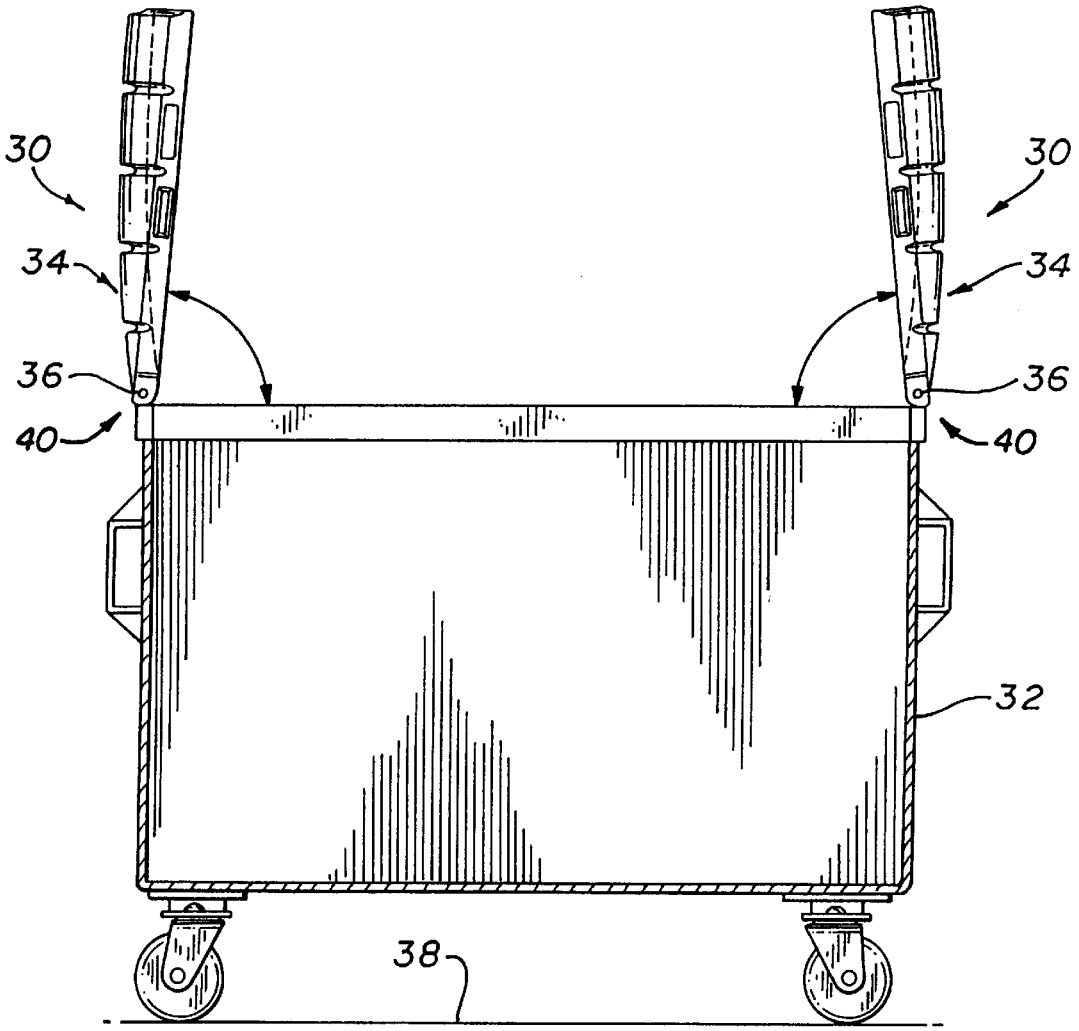
FIG. 1
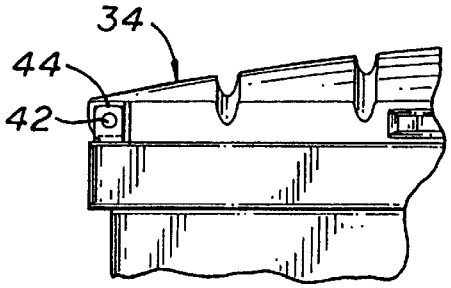
FIG. 3
FIG. 2
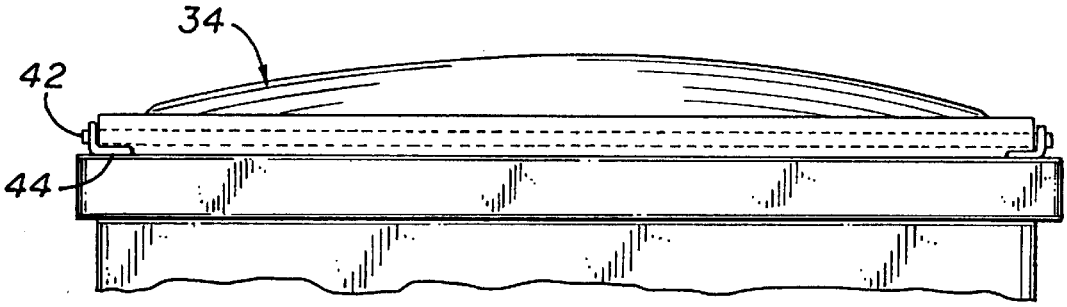

FIG. 30
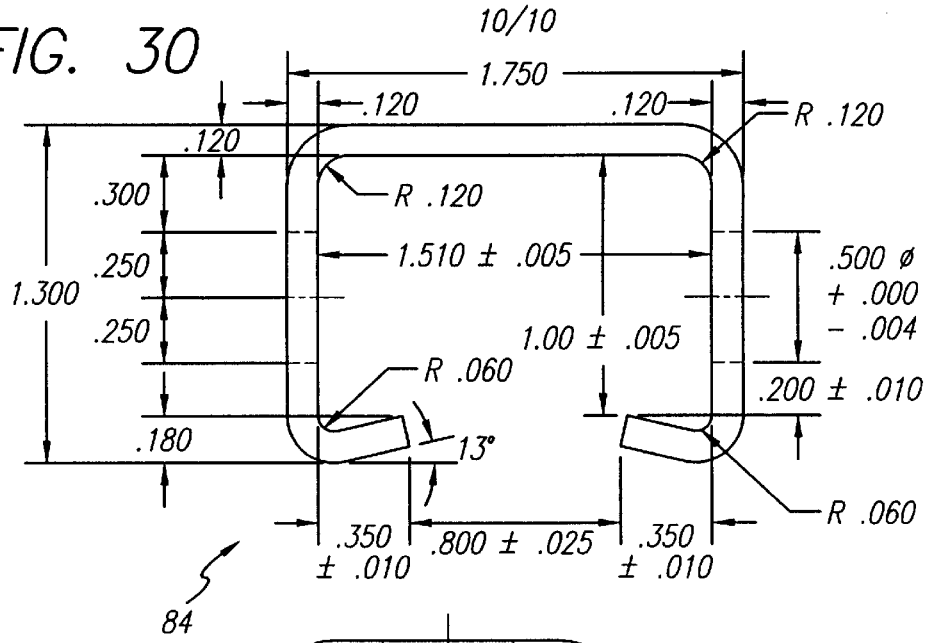
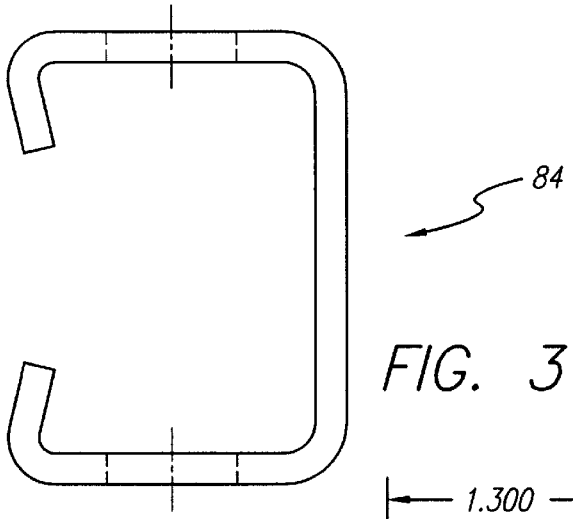
FIG. 31
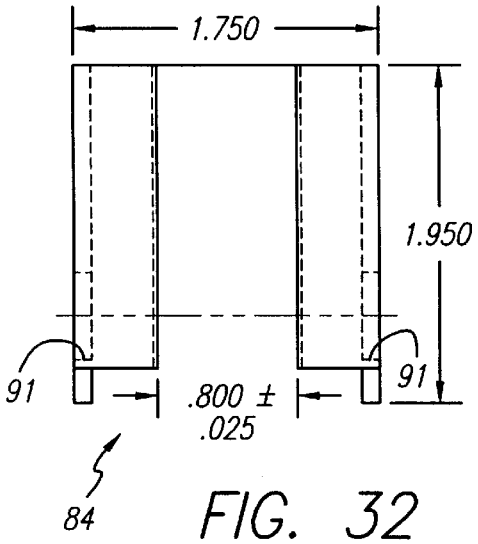
FIG. 32
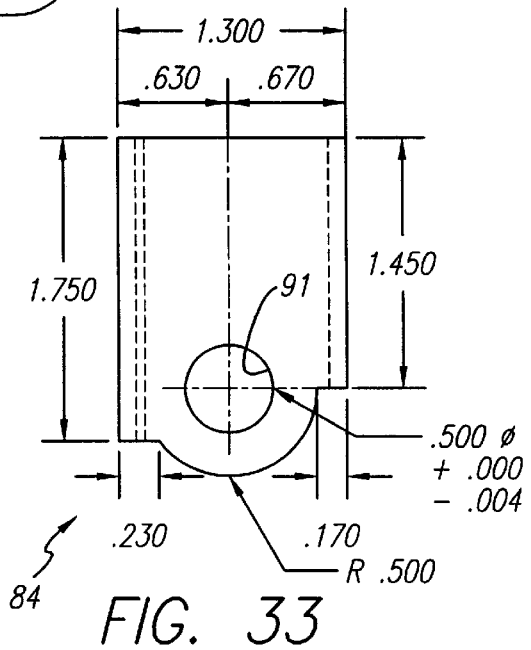
FIG. 33

LID ASSEMBLY INCLUDING PIVOTALLY-ATTACHED LID PROP MEMBER

CROSS-REFERENCE TO RELATED APPLICATION

This application is a continuation-in-part of U.S. patent application Ser. No. 08/858,349, filed May 19, 1997, entitled "IMPROVED REFUSE CONTAINER LID" by Craig V. Taylor, now U.S. Pat. No. 5,868,267.

BACKGROUND OF THE INVENTION

1. Field of the Invention

The present invention relates to a lid assembly including a lid prop and, more particularly, a lid assembly for a refuse container wherein the lid assembly includes at least one lid member pivotally secured to the container and configured to pivot within a predetermined range of motion and a pivotally-attached lid prop mechanism adapted to support the lid member in an open position and to automatically release the lid member after the container has been turned over to dump refuse from the container.

2. Description of the Related Art

Prior art lid assemblies for use with refuse containers such as dumpsters suffer from a number of deficiencies. When containers are raised and turned over to empty their contents into a garbage truck, there is a danger that their lids will swing out too far and be damaged or even sheared off from colliding with the garbage truck. Thus, it would be desirable to provide a mechanism which ensures that lid members which are attached to a refuse container are not damaged during the refuse dumping process. Furthermore, it would be desirable if such a mechanism were configured to ensure that the lid members closed automatically after the refuse is dumped from the container and the container is returned to its upright position. Additionally, it would be desirable if the same mechanism also allowed a person to manually prop open a lid member—so that refuse can be put into the container—and, if desired, leave the lid member propped open without interfering with any of the other aforementioned operational goals. Thus, an object of the present invention is to provide a simple, durable and economical lid assembly for a refuse container embodying these features.

SUMMARY OF THE INVENTION

In one aspect of the present invention, a lid assembly for a refuse container with an upper surface includes two lid members pivotally attached to the upper surface, two prop brackets and two identical lid props. Each lid member includes a pivoting edge with a cam-shaped lobe which contacts the upper surface of the container when the lid member is in an open position. Each lid member includes a bottom surface and a front surface. The two prop brackets are attached to the container with each prop bracket including a prop pivot rod positioned adjacent to the pivoting edge of one of the lid members. The lid props are pivotally secured about the prop pivot rods. Each lid prop includes a lid supporting surface complementary to the bottom surface of one of the lid members. Each lid prop includes a flange complementary to the front surface of one of the lid members.

In another aspect of the present invention, a lid assembly for a refuse container with an upper surface includes: a lid member pivotally attached to the upper surface of the container, a lid member including a cam-shaped lobe which contacts the upper surface of the container when the lid member is in an open position, the lid member including a bottom surface and a front surface; a prop bracket attached to the container and including a prop pivot rod; and a lid prop pivotally secured about the prop pivot rod, the lid prop including a lid supporting surface complementary to the bottom surface of the lid member and a flange complementary to the front surface of the lid member.

In another aspect of the present invention, a lid assembly for a refuse container with an upper surface includes: two lid brackets attached to the upper surface of the container, the lid brackets being formed to support a lid pivot rod for pivotally securing a lid to the container; a prop bracket mechanically coupled to one of the lid brackets and including a prop pivot rod; and a lid prop pivotally secured about the prop pivot rod and including a lid supporting surface complementary to a bottom surface of the lid. In a further aspect of the present invention, the lid prop includes a flange complementary to a front surface of the lid.

In another aspect of the present invention, a lid assembly for a refuse container with an upper surface includes: a prop bracket attached to the container and including a prop pivot rod; and a lid prop pivotally secured about the prop pivot rod and including a lid supporting surface complementary to a bottom surface of a lid pivotally secured to the container. In a further aspect of the present invention, a lid prop includes a flange complementary to a front surface of the lid.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 1 is a partial cross-sectional front view of an exemplary preferred embodiment of the lid assembly of the present invention shown attached to a refuse container;

FIG. 2 is a left side view of the lid assembly of FIG. 1 in a closed position showing an attaching mechanism for attaching the lid member to the refuse container;

FIG. 3 is a front view showing a hinge bracket of the attaching mechanism of FIG. 2 secured to the refuse container;

FIGS. 30 and 31 show top views of the prop bracket of FIG. 24; and

FIGS. 32 and 33 show respectively a rear view and a left side view of the prop bracket of FIG. 24.

DETAILED DESCRIPTION OF THE PREFERRED EMBODIMENTS

Figure 6:
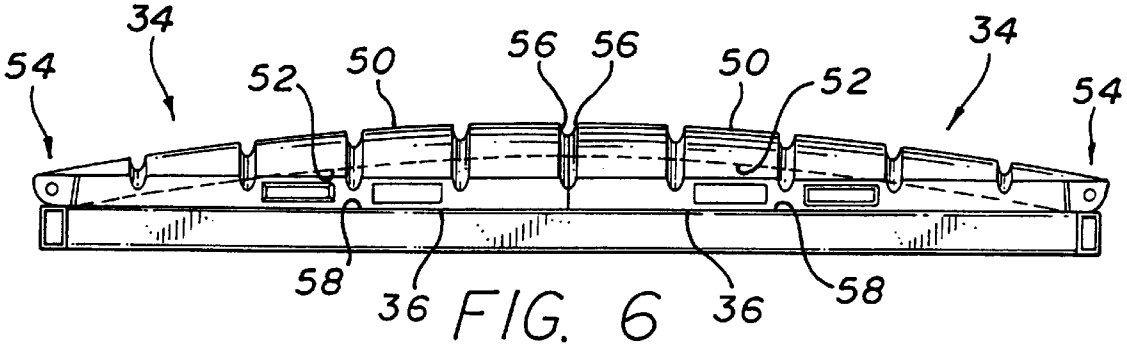
FIG. 6 is a front view of the lid assembly of FIG. 1 shown in its closed position.

FIG. 1 illustrates an exemplary preferred embodiment of a lid assembly 30 according to the present invention shown attached to a refuse container 32. In the illustrated preferred embodiment, the lid assembly 30 includes two lid members 34 which are pivotally attached to an upper surface 36 of the container 32. In the interest of simplifying FIG. 1, the upper surface 36 is shown as being substantially parallel to the ground 38. However, it should be appreciated that the subject matter of the present invention additionally and particularly contemplates a refuse container 32 where the upper surface 36 increases in distance from the ground 38 moving from the front of the container to the rear of the container, e.g., a side-hinged, front end loader (FEL) container.

Figure 4:
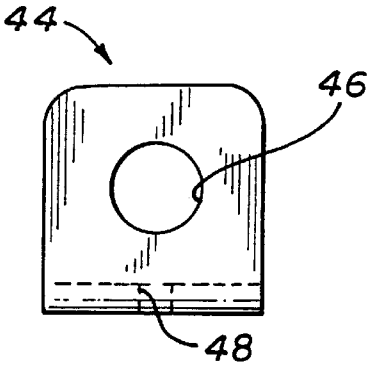
FIG. 4 is a detailed front view of the hinge bracket of FIG. 2.
Figure 5:
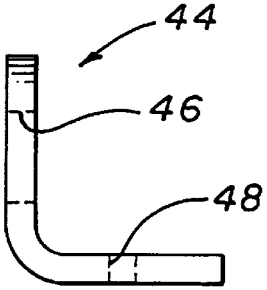
FIG. 5 is a detailed side view of the hinge bracket of FIG. 2.

The lid assembly 30 additionally includes a pivotal attaching mechanism 40 for pivotally attaching each lid member 34 to the upper surface 36 of the refuse container 32. As shown in FIGS. 2 and 3, the pivotal attaching mechanism 40 comprises, for example, a hinge rod 42 and two hinge brackets 44 for each lid member 34. A preferred rod 42 has a ¾ inch outer diameter. The hinge brackets 44 are formed as shown in FIGS. 4 and 5 with a cylindrical bore 46 appropriately sized, e.g., with a 49/64 inch inner diameter, to receive the rod 42. The hinge brackets 44 further include a bored and/or threaded channel 48 through which a bolt, screw or other conventional fastening mechanism is employed to secure the hinge brackets 44 to the upper surface 36 of the refuse container 32.

Referring to FIG. 6, the lid assembly 30 is shown with its two lid members 34 in a closed position. Generally, each lid member 34 includes a top surface 50 and a bottom surface 52 and is curved in shape. Each lid member 34 includes a pivoting edge 54, a curved edge 56, and surfaces 58 complementary to at least a portion of the upper surface 36 of the refuse container 32. When in the illustrated closed position, the complementary surfaces 58 are supported by the upper surface 36 and the curved edges 56 substantially abut as shown in FIG. 6. It should be appreciated that the subject matter of the present invention additionally contemplates lid members 34 where the complementary surfaces 58 are not necessarily flush with the upper surface 36 or directly supported thereby.

Another key aspect of the present invention is the generally "dome-like" shape of the lid assembly 30 when in its closed position. It has been observed that the lid assembly configuration shown in FIG. 6 has superior load (e.g., from the weight of snow on the lid members 34) bearing capabilities as compared to conventional plastic rear-hinged lid members that have a flat or planar top surface. Such conventional lid members bend or deform when sufficiently large loads are applied to them and, as a result, collapse into the container.

Figure 7:
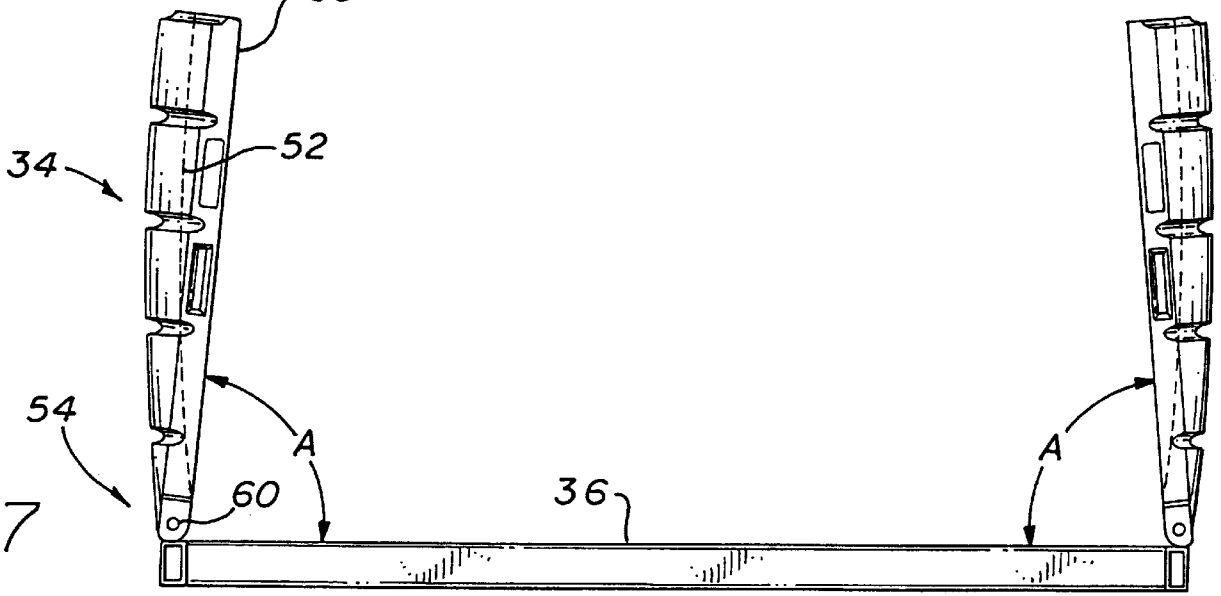
FIG. 7 is a front view of the lid assembly of FIG. 1 shown in its open position.
Figure 8:
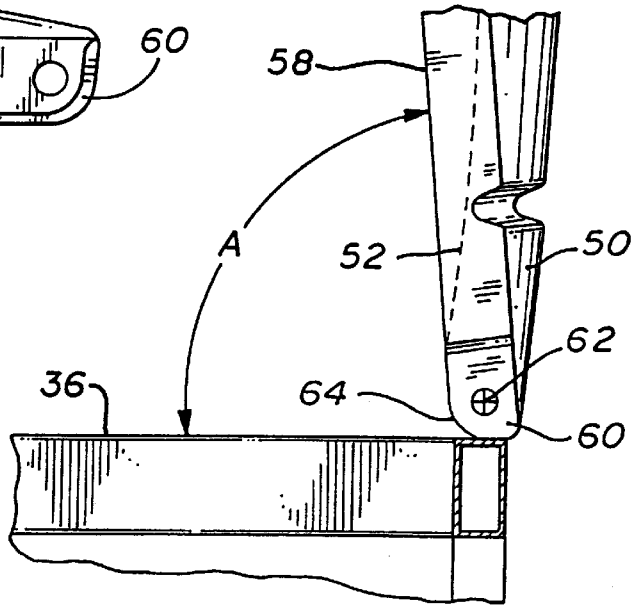
FIG. 8 is an enlarged portion of FIG. 7 showing the cam-shaped lobe of the lid member in greater detail.

Referring to FIGS. 7 and 8, the lid assembly 30 is shown with its two lid members 34 in an open position. The pivoting edge 54 is preferably formed with a cam-shaped lobe 60 which is adapted to allow a pivotal motion of each lid member 34 relative to the refuse container 32 or, more specifically, about a pivoting axis 62 at the center of the rod 42. In the exemplary preferred lid assembly 30, the lid members 34 are formed from a flexible polyethylene plastic and the lobes 60 are integrally formed thereon. For example, the lid members 34 may be formed of high strength plastic as disclosed in my U.S. Pat. No. 4,771,940, issued Sep. 20, 1988. However, it should be understood that the lid members 34 can be made from other flexible materials. Regarding the lobes 60, they may be formed as a series of lobes or as a single lobe for most of the length of the pivoting edge 54 of each lid member 34. Moreover, the lobes 60 are not necessarily integrally formed on the lid members 34 and may be separately manufactured from the lid members 34 and subsequently attached thereto.

As shown in FIG. 8, the lobes 60 include an outer surface 64 which varies in distance from the pivoting axis 62. Generally, the portion of the outer surface 64 adjacent to the top surface 50 of the lid member 34 is further from the pivoting axis 62 than the portion of the outer surface 64 near the bottom surface 52. In its open position, the complementary surfaces 58 preferably form an angle "A" of less than 90 degrees with the upper surface 36. A key aspect of the present invention is that the lobes 60 are shaped such that the maximum angle"A" is predetermined and limited by contact between the lobes 60 and the upper surface 36. Thus, the lid members 34 will not swing open too far when the refuse container 32 is turned upside down and lowered into a dumpster, an action which otherwise potentially results in damage to the lid members 34 caused if they come in contact with the sides of the rubbish truck hopper.

Another key aspect of the present invention is that the pivotal attaching mechanism 40 serves to position the pivoting axis 62 of the lid member 34 at a predetermined distance from the upper surface 36. The ability to accurately establish a desired maximum angle "A" depends upon being able to control the aforementioned predetermined distance. For this reason, a sturdy, metal rod 42 with a ¾ inch diameter is preferably employed.

Still another key aspect of the present invention is the curved shape of the lid members 34. Generally, the top surface 50 of each lid member 34 is convex while the bottom surface is concave. As best illustrated in FIG. 7, the angle between the bottom surface 52, at the center of the lid member 34, and the upper surface 36 is greater than the predetermined angle "A". This allows the trash or refuse to fall from the upside down container 32 while the lid assembly 30 is in its open position with less restriction. Conventional lid assemblies where a mechanical stop is employed to establish a maximum angle between the bottom surface of a flat lid member and the upper surface of a refuse container (of, for example, 85 degrees) suffer from a "funnel effect" whereby the trash stream damages the lid members and shortens their lives. The lid assembly 30 of the present invention addresses this problem by providing an open position where the angle between the bottom surface 52, at the center of the lid member 34, and the upper surface 36 is approximately 90 degrees, thereby substantially eliminating contact between the lid members 34 and the trash stream.

Still another advantage of the curved lid members 34 is that their center of gravity facilitates an automatic lid closure while the refuse container 32 is being lowered back to the ground after the refuse therein has been dumped. Furthermore, the curved shape of the lid members 34 substantially reduces a lid whip lash effect when the lid members 34 are first thrown open during dumping.

Figure 9:
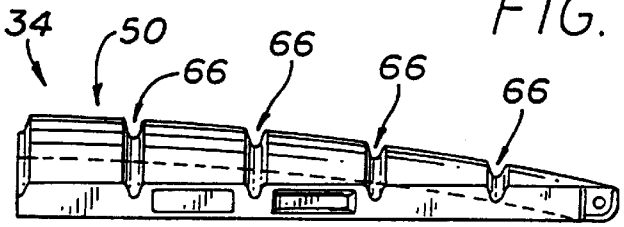
FIG. 9 is a front view of one of the lid members shown in FIG. 6.
Figure 10:
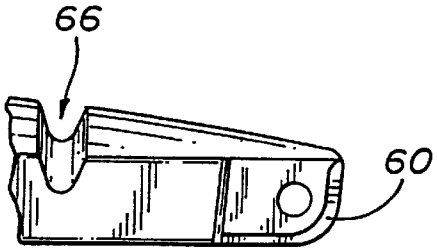
FIG. 10 is an enlarged portion of FIG. 9 showing the cam-shaped lobe of the lid member in greater detail.
Figure 11:
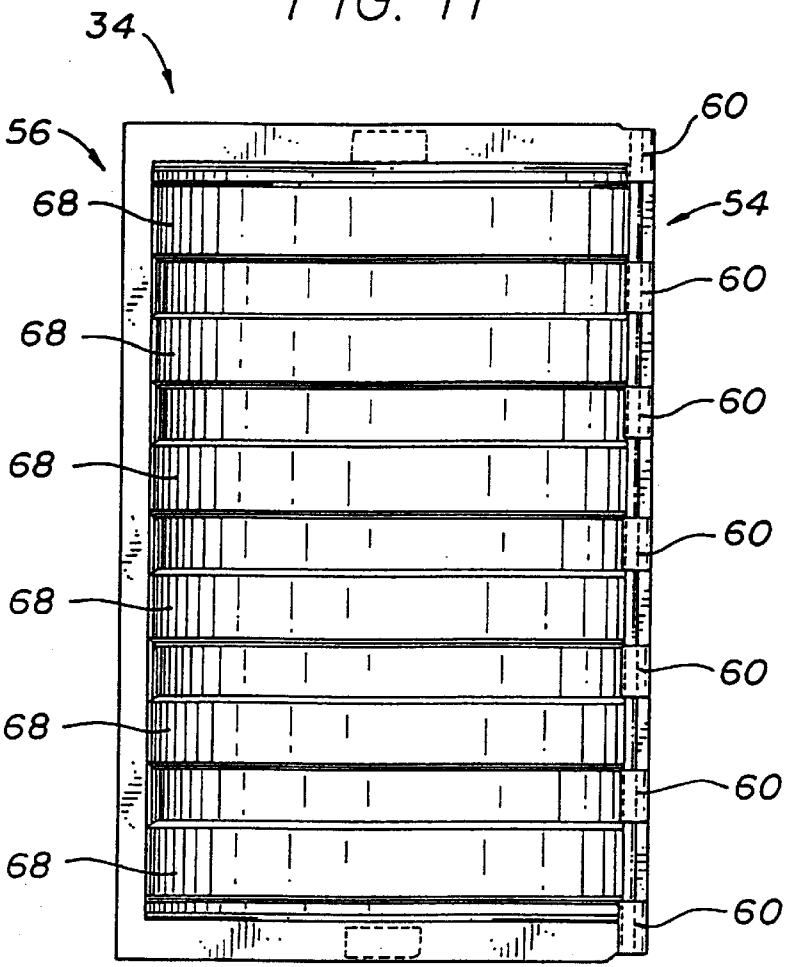
FIG. 11 is a bottom view of the lid member of FIG. 9.
Figure 12:
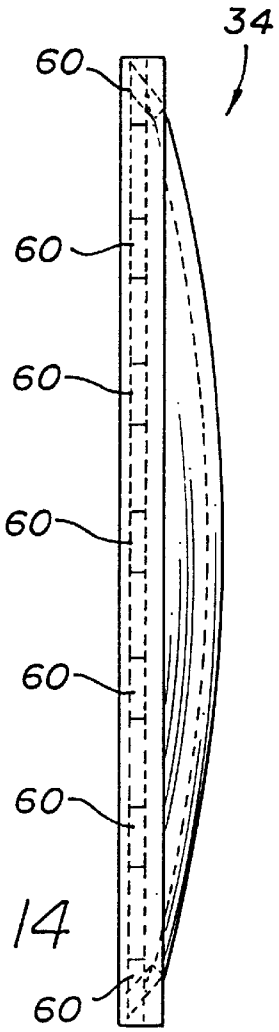
FIG. 12 is a top view of the lid member of FIG. 9.
Figure 14:
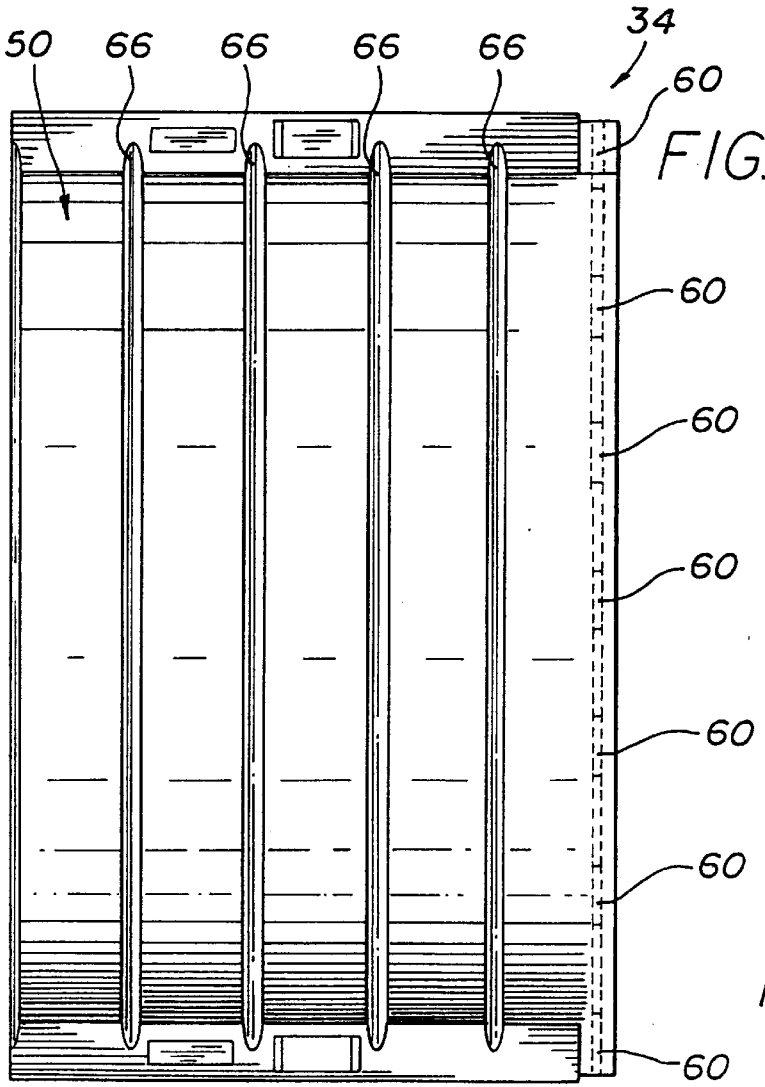
FIG. 14 is a right side view of the lid member of FIG. 12.
Figure 13:
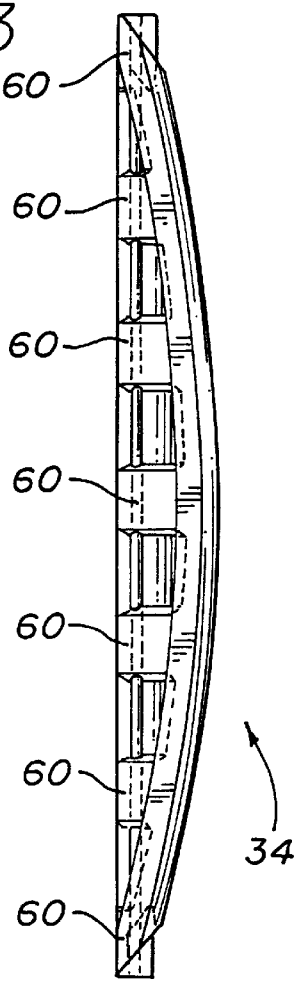
FIG. 13 is a left side view of the lid member of FIG. 12.

Referring to FIGS. 9–13, and to FIGS. 9 and 12 in particular, the top surface 50 preferably includes a plurality of substantially parallel grooves 66 formed therein as shown. Referring to FIG. 11, the bottom surface 52 preferably includes a plurality of substantially parallel grooves 68 formed therein spanning perpendicularly from the pivoting edge 54 to the curved edge 56 of the lid member 34. This formation of the grooves 68 stiffens the bottom plane of the lid member 34 and facilitates a more efficient egress of refuse from the container 32.

The lid members 34 can be constructed in a single or double wall design. In a single wall design, the grooves 66 are preferably oriented to run from the pivot edge 54 to the curved edge 56 to accommodate the trash stream flow direction.

Figure 15:
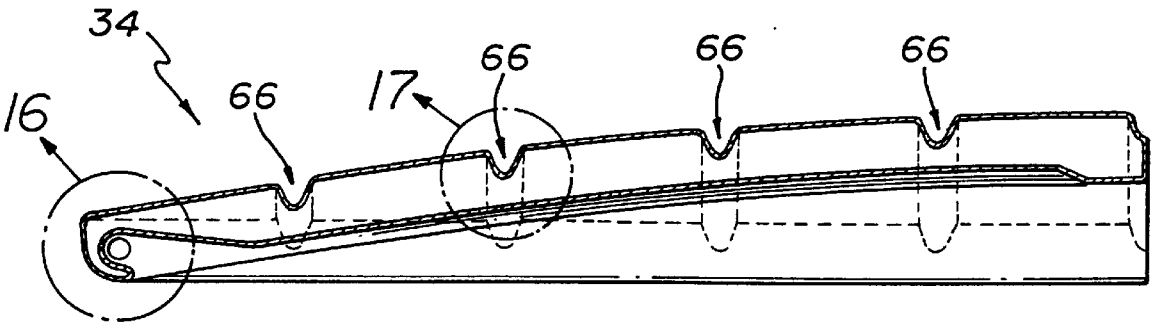
FIG. 15 is front cross-sectional view of one of the lid members shown in FIG. 6.
Figure 17:
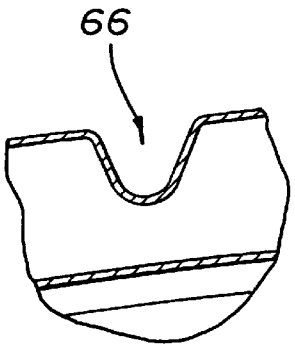
FIG. 17 is an enlarged portion of FIG. 15 showing a groove in the top surface of the lid member in greater detail.
Figure 16:
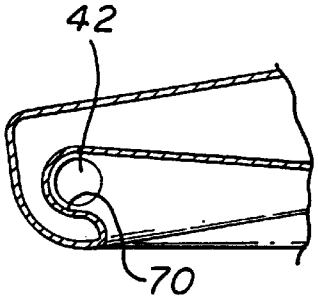
FIG. 16 is an enlarged portion of FIG. 15 showing the cam-shaped lobe of the lid member in greater detail.
Figure 18:
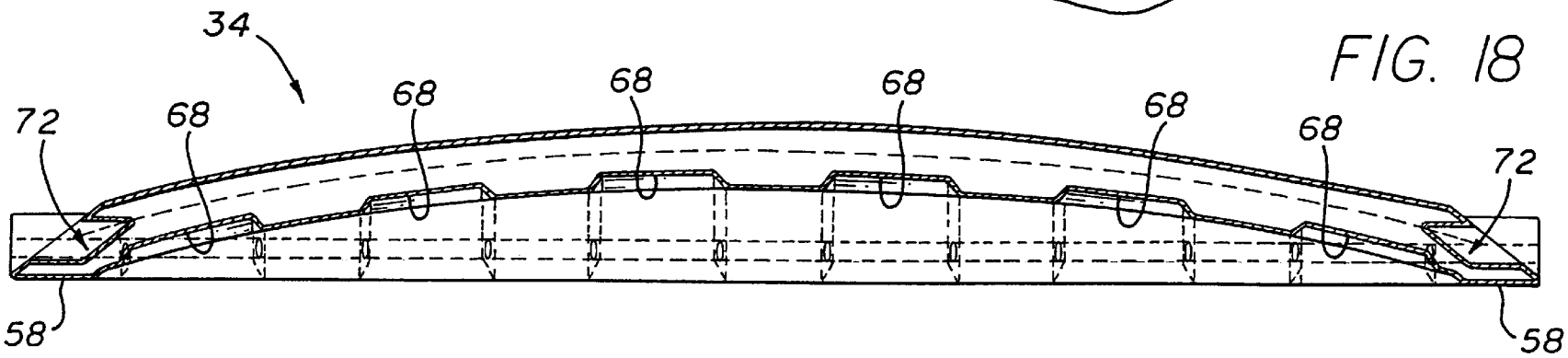
FIG. 18 is a right side cross-sectional view of the lid member of FIG. 15.

FIGS. 15 and 16 provide cross-sectional views of the preferred lid member 34 and particularly illustrate that the lobes 60 are formed with an inner surface 70 sized to be fitted around the rod 42 as shown. FIGS. 17 and 18 respectively illustrate exemplary contours for the grooves 66, 68. It should be understood that the lid members 34 can be made without any grooves or with grooves differing in shape, arrangement, depth, etc. Referring to FIG. 18, each lid member 34 preferably includes two recessed handles 72 formed adjacent to the surfaces 58 as shown. As may be readily appreciated, other handle configurations, preferably those which do not significantly project from the lid member 34, can be employed.

Figure 19:
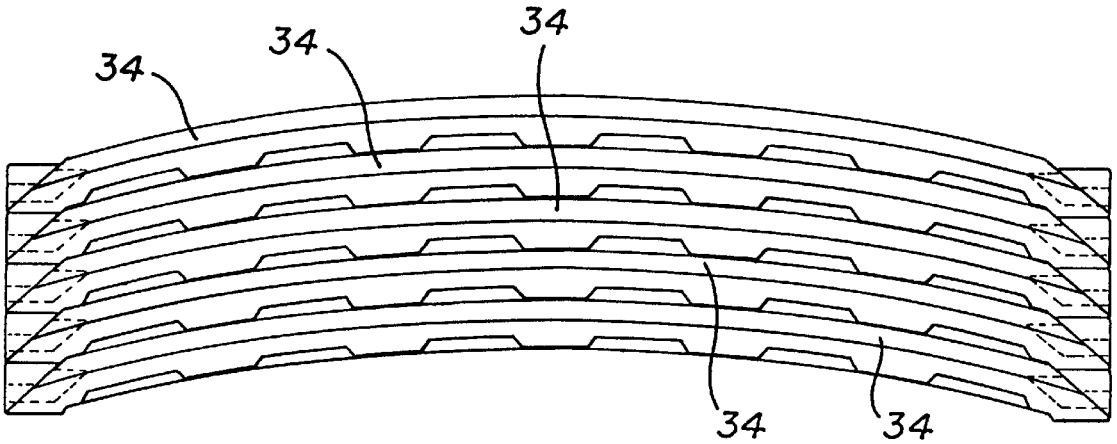
FIG. 19 is a cross-sectional right view a plurality of the lid members of FIG. 6 stacked in a nested configuration.
Figure 20:
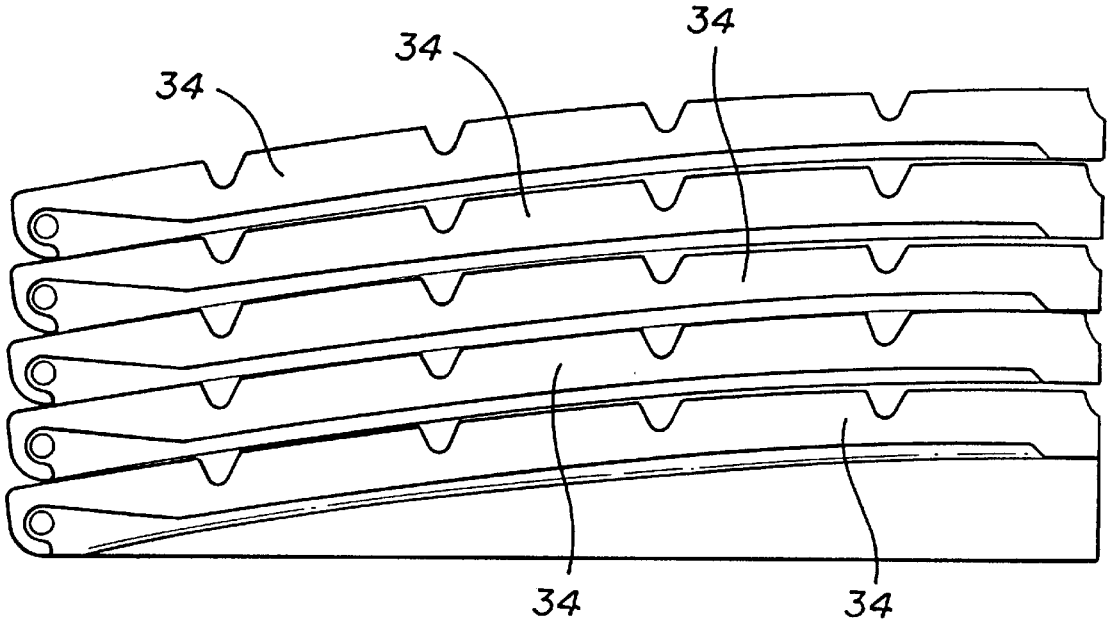
FIG. 20 is a cross-sectional front view a plurality of the lid members of FIG. 6 stacked in a nested configuration.

As shown in FIGS. 19 and 20, an additional aspect of the present invention is that the top and bottom surfaces 50, 52 are contoured such that a plurality of the lid members 34 can be interfitted in a nested fashion. This facilitates more efficient shipping and storage.

Figure 21:
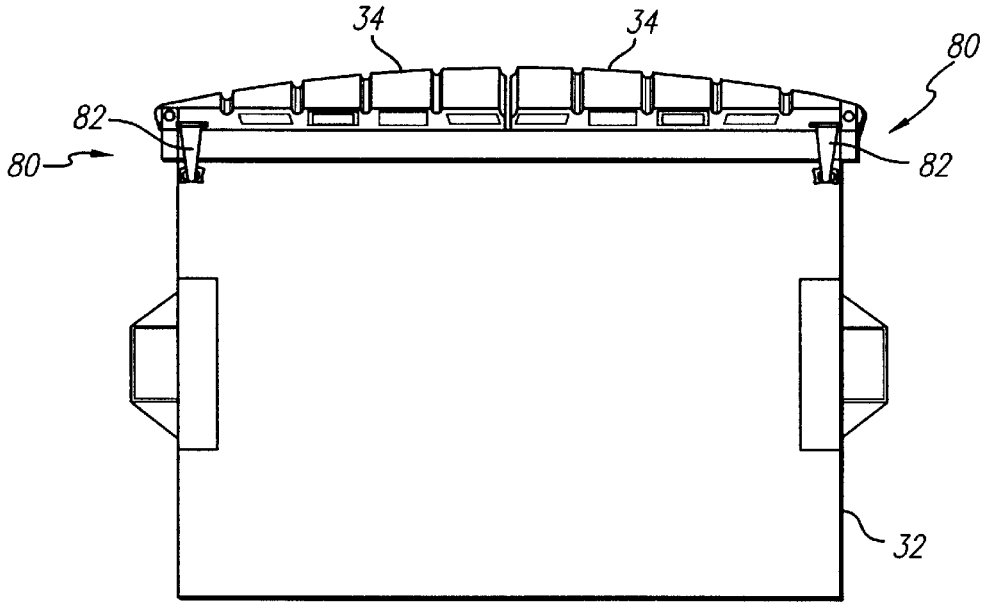
FIG. 21 is a front view of an alternative preferred embodiment of a lid assembly according to the present invention with two lid members shown in a closed position.
Figure 22:
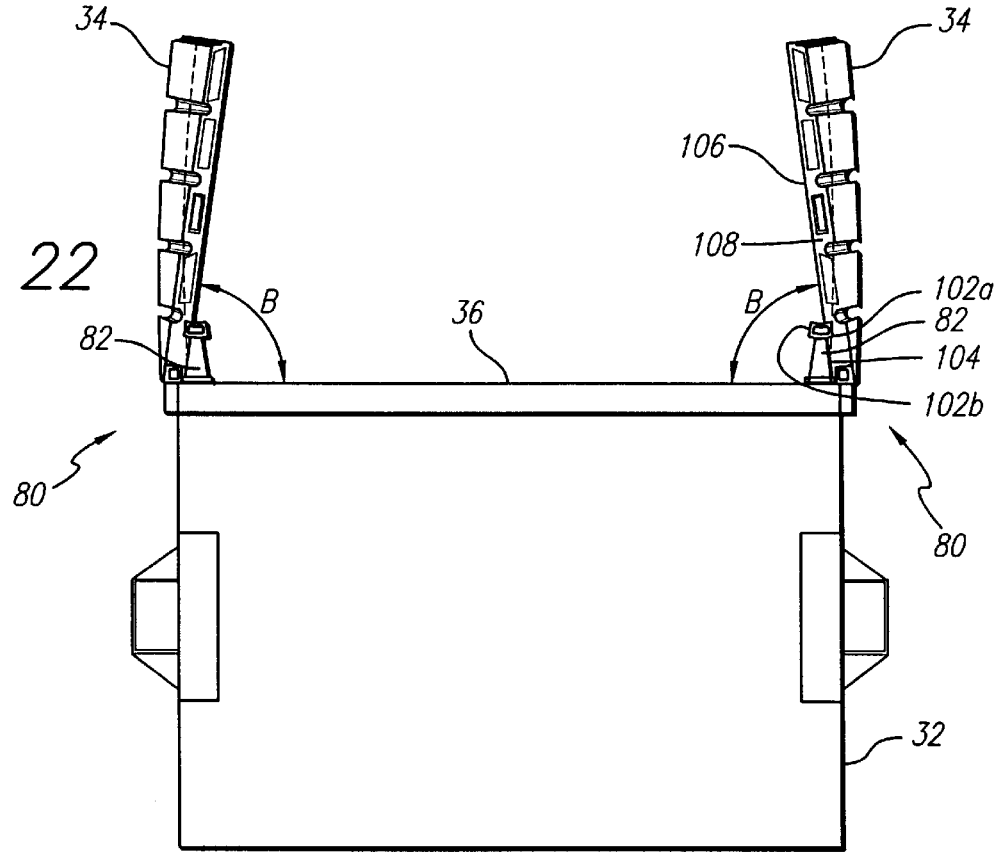
FIG. 22 shows the lid assembly of FIG. 21 in an open position with lid props of the lid assembly supporting the lid members.

FIGS. 21 and 22 show an alternative preferred lid assembly 80 for the refuse container 32 with the lid members 34 in closed and open positions, respectively. Preferably, one lid assembly 80 is provided for each lid member 34. As shown in FIG. 22, each of the two lid assemblies 80 includes a lid prop 82 which is particularly adapted to support its corresponding lid member 34 when in the open position.

Figure 25:
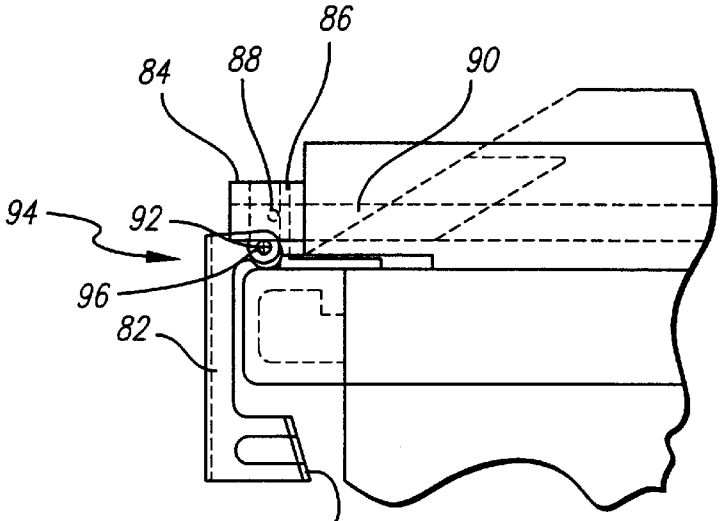
FIGS. 23, 24 and 25 show respectively a left side view, front view and right side view of the lid assembly of FIG. 21, the lid assembly including a lid prop, rod bracket and a prop bracket.
Figure 24:
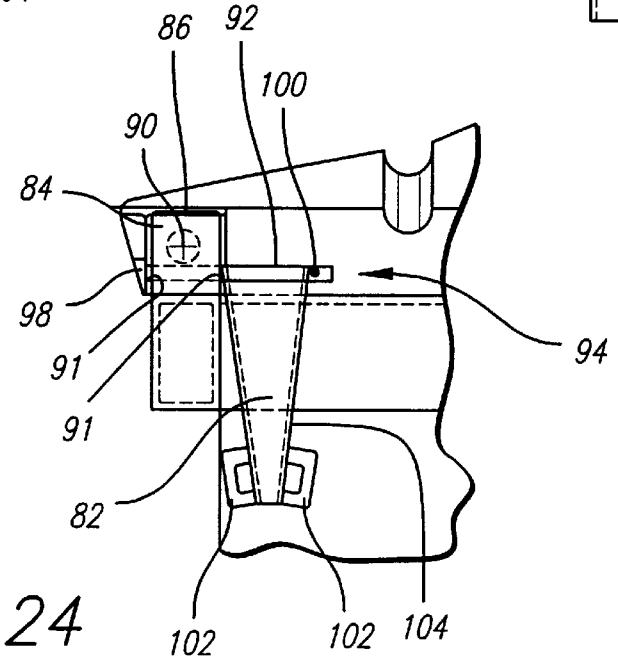
Figure 23:
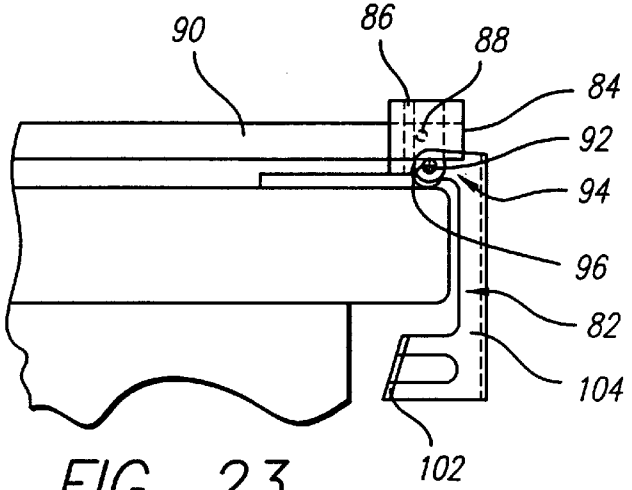
Figure 28:
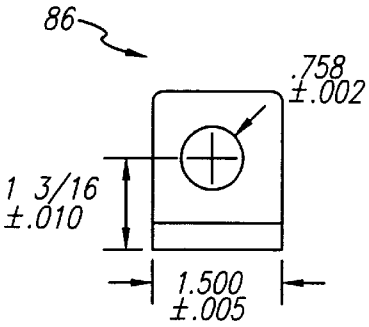
FIGS. 28 and 29 show respectively a back view and a right side view of the rod bracket of FIG. 24.
Figure 29:
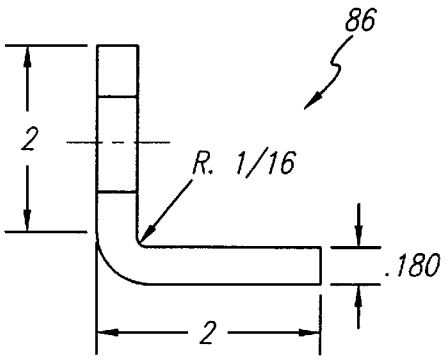

Referring to FIGS. 23–25, each lid assembly 80 also includes a prop bracket 84 which is mechanically coupled to the refuse container 32. More specifically, and with reference to the illustrated preferred embodiment, the prop bracket 84 is sized to be fitted over a lid rod bracket 86 and secured thereto with a pin member 88. The lid rod brackets 86 support a lid pivot rod 90 about which a lid member 34 is pivotally secured as discussed with reference to the previous preferred embodiment. As best shown in FIG. 24, the prop bracket 84 is formed or bored with two cylindrical apertures 91 sized to receive a prop pivot rod 92.

In addition to supporting the prop pivot rod 92, the prop bracket 84 also serves an important safety function. Namely, the prop bracket 84 serves as a guard to prevent the heavy (7 lb.) lid pivot rod 90 from breaking loose as a result of the sometimes forceful shaking of the container 32 during the refuse dumping process. The hammering of the lid pivot rod 90 against its fasteners, e.g., cotter pin or tension pin, could shear a fastener over time allowing the lid pivot rod 90 to drop and potentially cause serious damage or injury. Advantageously, the prop bracket 84 further secures the lid pivot rod 90 by virtue of the nature of the interlocking assembly of the prop bracket 84, prop pivot rod 92 and lid rod bracket 86.

The lid prop 82 includes a pivoting portion 94 which, in the illustrated preferred embodiment, includes two cylindrical channels 96. After the lid member 34 is assembled to the lid pivot rod 90, the prop bracket 84 is fitted over the lid rod bracket 86 and pinned into place. Next, the prop pivot rod 92 is slid through the apertures 91 of the prop bracket 84. The pivoting portion 94 of the lid prop 82 is then slid onto the prop pivot rod 92. On opposing ends of the prop pivot rod 92, an end portion 98 of the prop pivot rod 92 which is larger in outer diameter than the portion of the prop pivot rod 92 that is passed through the apertures 91 and a pin member 100 secure the prop pivot rod 92 within the prop bracket 84 and prevent the lid prop 82 from sliding off the prop pivot rod 92.

Figure 26:
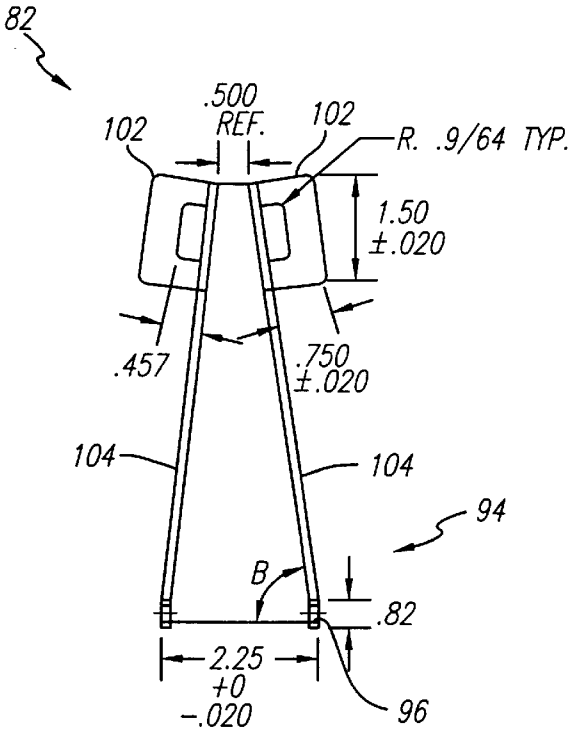

Each lid prop 82 also includes symmetrical flanges 102 and symmetrical lid supporting surfaces 104. Referring to FIGS. 22 and 26, a preferred lid prop 82 is formed such that the supporting surface 104 forms a supporting surface angle B with the upper surface 36 of the container 32 when the lid prop 82 is in a lid supporting position. Generally, the supporting surface angle B is slightly less than the maximum angle A (FIG. 8) between the lid member 34 and the upper surface 36 of the container 32 as limited by the cam-shaped lobes 60.

Referring to FIG. 22, the supporting surface 104 contacts and supports a bottom surface 106 of the lid member 34 when: the lid prop 82 is in its lid supporting position, the lid member 34 is in an open position; and the container 32 is in an upright position. An exemplary preferred supporting surface angle B is 82°±1°. The symmetrical nature of the flanges 102 allows a single lid prop 82 to be manufactured for use with either right or left side opening lids.

As shown in FIG. 22, when a lid prop 82 is in its lid supporting position, the flange 102*a* faces a front surface 108 of the lid member 34. The flanges 102 are sufficiently wide to prevent the lid prop 82 from falling inward toward the lid member 34, e.g., as a result of a person inadvertently hitting the lid prop 82 while loading trash into the container 32 or when the lid member 34 is deflected by a wind gust. To this end, the flanges 102 are sized in consideration of the length of the flange 102 and the difference between the maximum lid angle A and the supporting surface angle B. The flange 102*b* serves as a convenient handle to raise or lower the lid prop 82.

Figure 27:
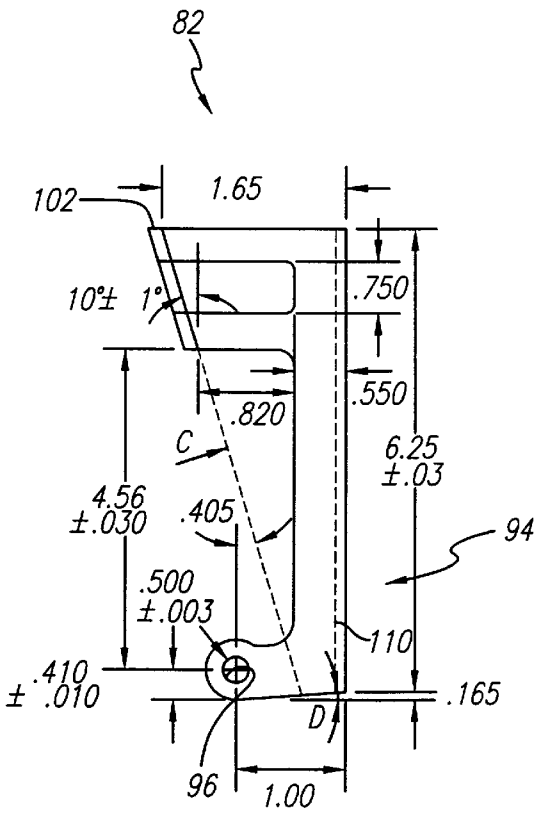
FIGS. 26 and 27 show respectively a front view and a side view of the lid prop of FIG. 24 in a raised position.

As best shown in FIG. 27, the lid prop 82 is formed such that gravity acts on the center of gravity of the lid prop 82 forcing the flange 102 toward the front surface 108 of the lid member 34 when the container 32 is in an upright position. The phantom line C represents the front surface 108 of the lid member 34 when the lid prop 82 is in its lid supporting position. The lid prop 82 includes a beveled surface 110 which is substantially parallel to the upper surface 36 of the container 32 when the lid prop 82 is in its lid supporting position. In a preferred embodiment, the angle D is 10°±1°.

If a lid member 34 is supported by its lid prop 82 at the time the container 32 is dumped, the lid prop 82 disengages from the lid member 34 as the container 32 is tipped toward the lid prop 82. When the container 32 is lowered back to the ground, the lid prop 82 falls to a lowered position as shown in FIG. 21 and the lid member 34 closes itself thereby preventing rain and animals from getting into the container 32.

With regard to materials, the lid prop 82, prop bracket 84 and lid rod bracket 86 comprise steel in an exemplary preferred embodiment. As these items are handled by persons, they are preferably tumbler deburred to remove all sharp edges and provided with a black-oxide coating.

It is noted in passing that certain specific dimensions, or other specific information are given relative to various preferred embodiments of the invention. It is to be understood that these dimensions are merely illustrative or representative of preferred embodiments, and that different dimensions may be employed to implement the present invention, without departing from the spirit and scope of the invention.

In conclusion, it is to be understood that the foregoing detailed description and the accompanying drawings illustrate the principles of the invention. However, various changes and modifications may be employed without departing from the spirit and scope of the invention. Thus, by way of example and not of limitation, it is contemplated that a lid assembly could include a single or more than two lid members.

Furthermore, lid member curvatures other than those particularly disclosed can be employed while still deriving the benefits of the disclosed invention. Accordingly, the present invention is not limited to the specific forms shown in the drawings and described in detail hereinabove.

What is claimed is:

1. A lid assembly for a refuse container with an upper surface, the lid assembly comprising:

two lid members pivotally attached to the upper surface of the container, each said lid member including a pivoting edge with a cam-shaped lobe which contacts the upper surface of the container when said lid member is in an open position, each said lid member including a bottom surface and a front surface;

two prop brackets attached to the container, each said prop bracket including a prop pivot rod positioned adjacent to said pivoting edge of one of said lid members; and two identical lid props pivotally secured about said prop pivot rods, each said lid prop including a lid supporting surface complementary to said bottom surface of one of said lid members, each said lid prop including a flange complementary to said front surface of one of said lid members.

2. The lid assembly for a refuse container of claim 1 wherein:

said bottom surfaces are concave.

3. The lid assembly for a refuse container of claim 1 wherein:

each said bottom surface is formed with grooves perpendicular to its pivoting edge.

4. The lid assembly for a refuse container of claim 1 wherein:

said lid members comprise a molded plastic.

5. A lid assembly for a refuse container with an upper surface, the lid assembly comprising:

a lid member pivotally attached to the upper surface of the container, said lid member including a cam-shaped lobe which contacts the upper surface of the container when said lid member is in an open position, said lid member including a bottom surface and a front surface;

a prop bracket attached to the container and including a prop pivot rod; and a lid prop pivotally secured about said prop pivot rod, said lid prop including a lid supporting surface complementary to said bottom surface of said lid member and a flange complementary to said front surface of said lid member.

6. The lid assembly for a refuse container of claim 5 wherein:

said bottom surface is concave.

7. The lid assembly for a refuse container of claim 5 wherein:

said lid member comprises a molded plastic.

8. A lid assembly for a refuse container with an upper surface, the lid assembly comprising:

two lid brackets attached to the upper surface of the container, said lid brackets being formed to support a lid pivot rod for pivotally securing a lid to the container;

a prop bracket mechanically coupled to one of said lid brackets and including a prop pivot rod; and a lid prop pivotally secured about said prop pivot rod and including a lid supporting surface complementary to a bottom surface of the lid.

9. The lid assembly for a refuse container of claim 8 wherein:

said lid prop is mechanically coupled to the container such that said lid supporting surface contacts the bottom surface of the lid and supports the lid when said lid prop is in a lid supporting position, the lid is in an open position, and the container is in an upright position.

10. The lid assembly for a refuse container of claim 8 wherein:

said lid prop includes a flange complementary to a front surface of the lid.

11. The lid assembly for a refuse container of claim 10 wherein:

the lid is mechanically coupled to the container such that a lid angle formed by the bottom surface of the lid and the upper surface of the container does not exceed a predetermined value when the lid is in an open position; and said flange faces the front surface of the lid when said lid prop is in a lid supporting position, the lid is in the open position, and the container is in an upright position.

12. The lid assembly for a refuse container of claim 8 wherein:

the lid is mechanically coupled to the container such that a lid angle formed by the bottom surface of the lid and the upper surface of the container does not exceed a predetermined value when the lid is in an open position; and said lid prop is mechanically coupled to the container such that a supporting surface angle formed by the supporting surface of the lid prop and the upper surface of the container is less than the lid angle when a force is directed against an inner surface of the lid such as when the container is manipulated to a position facilitating an egress of refuse from the container.

13. A lid assembly for a refuse container with an upper surface, the lid assembly comprising:

a lid pivotally secured to a refuse container, said lid rotating about a pivot rod extending in a predetermined direction;

a prop bracket attached to the container and including a prop pivot rod extending in a direction substantially different from said predetermined direction;

a lid prop pivotally secured about said prop pivot rod and including a lid supporting surface complementary to a bottom surface of a lid pivotally secured to the container; and said lid prop being selectively rotatable from an inactive position where it is out of contact with said lid into an active orientation wherein said lid supporting surface engages said lid and holds the lid in an open orientation.

14. The lid assembly for a refuse container of claim 13 wherein:

said lid prop is mechanically coupled to the container such that said lid supporting surface contacts the bottom surface of the lid and supports the lid when said lid prop is in a lid supporting position and the lid is in an open position.

15. The lid assembly for a refuse container of claim 13 wherein:

said lid prop includes a flange complementary to a front surface of the lid.

16. The lid assembly for a refuse container of claim 13 wherein:

the lid is mechanically coupled to the container such that a lid angle formed by the bottom surface of the lid and the upper surface of the container does not exceed a predetermined value when the lid is in an open position; and said flange faces the front surface of the lid when said lid prop is in a lid supporting position, the lid is in the open position, and the container is in an upright position.

17. The lid assembly for a refuse container of claim 13 wherein:

the lid is mechanically coupled to the container such that a lid angle formed by the bottom surface of the lid and the upper surface of the container does not exceed a predetermined value when the lid is in an open position; and said lid prop is mechanically coupled to the container such that a supporting surface angle formed by the supporting surface of the lid prop and the upper surface of the container is less than the lid angle when a force is directed against an inner surface of the lid such as when the container is manipulated to a position facilitating an egress of refuse from the container.

18. A lid assembly as defined in claim 13 wherein said lid prop has a normal rest position substantially against the front of the container out of engagement with the lid, whereby when the refuse container is dumped upside down with the lid propped open, and is later returned to its erect position, the prop falls away from the lid and the lid is automatically returned to its closed configuration.

* * * * *